US005888118A

United States Patent [19]

Kishi

[11] Patent Number: 5,888,118

[45] Date of Patent: Mar. 30, 1999

[54] GARMENT WITH AN INNER LINING FOR BODY SHAPE ADJUSTMENT

[75] Inventor: Hisato Kishi, Nagaoka, Japan

[73] Assignee: Kishi Co., Ltd., Niigata, Japan

[21] Appl. No.: 890,519

[22] Filed: Jul. 9, 1997

[51] Int. Cl.[6] ..... A41C 1/00

[52] U.S. Cl. ..... 450/122; 450/95; 450/126; 450/156; 450/99; 2/73; 2/243.1

[58] Field of Search ..... 2/73, 69, 69.5, 2/79, 227, 70, 71, 72, 243.1; 450/94, 95, 107, 108, 109, 110, 111, 112, 113, 114, 115, 116, 117, 118, 119, 120, 121, 122, 123, 124, 125, 126, 127, 128, 129, 130, 131, 132, 133, 134, 155, 156, 153, 99

[56] References Cited

U.S. PATENT DOCUMENTS

| | | | |
|---|---|---|---|
| 3,068,871 | 12/1962 | Rapp | 450/95 |
| 3,131,698 | 5/1964 | Morano | 450/99 |
| 3,298,373 | 1/1967 | Marchisella | 450/99 |
| 3,333,589 | 8/1967 | Cohen et al. | 450/95 |
| 3,339,554 | 9/1967 | Nobbs | 450/99 |
| 4,069,513 | 1/1978 | Shiller et al. | 450/95 |

FOREIGN PATENT DOCUMENTS

Hei 6-12118 9/1994 Japan .

*Primary Examiner*—Jeanette Chapman
*Attorney, Agent, or Firm*—Cantor Colburn LLP

[57] ABSTRACT

A garment having provided with an inner lining for adjusting body shape of the buttocks and the abdomen. The garment is formed by combining woven fabrics together, each of which has a modulus of expansibility depending on a stretch direction from the weaving direction of the fabric. The buttocks regulating piece is oriented in a direction that the direction of the high modulus of expansibility of the fabric is selected to gather and push up the buttocks and is sewed between the front body and the back body, while an abdominal regulating piece is formed of at least two sheets, each oriented so that the direction of the low modulus of expansibility of the fabric is in the lateral direction to the abdomen. The sheets are sewed onto the front body so as to at leastartially overlap each other within the abdominal region including the lower abdominal region.

17 Claims, 8 Drawing Sheets

GARMENT WITH AN INNER LINING FOR BODY SHAPE ADJUSTMENT

TECHNICAL FIELD OF THE INVENTION

The present invention relates to a garment having an inner lining sewed thereto with a function of adjusting body shape.

BACKGROUND OF THE INVENTION

Some garments are assembled by sewing together fabrics made of high expansibility material. Particularly, garments such as trousers and skirts are suitable products for fabrics with highly expansible material because of the added benefit of allowing a wearer to freely perform bending and stretching of the knees and the waist. These products are therefore to some extent developed and commercialized. A garment made of highly expansible material also has an effect that the body shape of the wearer appears slim because the expansible garment tightly fits their body.

However, the highly expansible material also makes, superfluous body fat or the like to be clearly recognizable. In the past, an undergarment, such a girdle, with an adjusting function was used for adjusting the appearance of the body shape.

A girdle with a high tightening force is effective in adjusting the body shape. On the other hand, some wearers feel oppressed or compressed by the tightening force of the girdle, and many people find it difficult to wear a girdle all day long. Functionality, one of the advantages of a garment formed of highly expansible material, may be lessened by wearing the garment together with an undergarment with a high tightening force. Additionally, the wearer may find it annoying that a girdle must be worn in addition to the clothing.

In Japanese Utility Model Application No. Hei 6-12111, a garment having an inner lining sewed thereto for adjusting body shape without using an undergarment is disclosed. The inner lining is made by sewing a plurality of expansible materials together so as to provide support for the hips and buttocks. It is possible to attach the lining to an outer clothing to eliminate the annoyance that an undergarment such as a girdle must be worn in addition to the outer clothing.

In detail, the lining disclosed in the above application has a front body formed of a warp knitting fabric with low expansibility and high elasticity, and a lining back body formed of a warp knitting fabric with high expansibility and low elasticity. Each of the front body and the back body is fixed and separately attached with tension to the clothing. Two adjusting parts, each of which is formed different type of low expansibility fabric, are sewed to a lower buttocks part of the back body, so as to at least partially overlap each other. The front body, with low expansibility, presses the abdomen and adjusts or flattens its shape. The adjusting parts with low expansibility, which are sewed onto the lower buttocks part of the back body to overlap each other, press and push up the sags in lower parts of the buttocks. The superfluous flesh of the buttocks which is pushed up by the back body is wrapped by the back body with high expansibility so that the buttocks are adjusted.

In the described lining of this art, however, the front body, the back body, and the adjusting parts are individually sewed to the clothing. This means there is no consideration in the adjustment for regarding the abdomen and the buttocks as being united. Accordingly, garments with this type of lining have little effect for relieving tight fitting feeling for wearers.

Furthermore, it is difficult to wrap and push up fat buttocks sags expand in the direction of the thighs or also in a horizontal direction.

In the available lining, a part for adjusting abdomen is the front body formed of the fabric with low expansibility and high elasticity. The expansible force and the elastic force of the front body fabric directly produce a tightening force or an adjusting force for the abdomen and, when it is necessary to boost the tightening force, material with very low expansibility and high elasticity must be utilized. When such a fabric is sewed to the front body of the lining, for example, though a large tightening force can be obtained, the wearer may feel oppressed similar to the case of wearing a girdle. In this adjusting method, the abdomen is only pressed uniformly in along plane, and there is no consideration for three-dimensional adjustment. Therefore, it is difficult for this type of garment adjust the body shape conforming to the abdominal curve without giving an oppressive or offensive feeling to the wearer.

Furthermore, since the buttocks sag not in both the horizontal and downward directions, it is difficult for the prior garment, which is made by sewing different materials in a modulus of expansibility together to horizontally adjust the buttock sag.

Moreover, adjustment of body shape is also desired from skirts, while the prior garment was invented for adjusting the shape of the abdomen and the buttocks while wearing slacks. There is a problem that wearing a skirt will reveal abdominal fat, even though the skirt does not follow the body as closely as slacks.

The present invention, developed for overcoming the above problems, has an object of providing a garment having an inner lining sewed thereto for adjusting body shape in a manner that the abdomen and the buttocks are regarded as united. A tightening force or a body adjusting force is provided in a range that the functionality of the garment is not degraded while a comfortable feeling can be obtained and an oppressive feeling is not given to the wearer.

DISCLOSURE OF THE INVENTION

To achieve the above object, the garment of the present invention has an inner lining for adjusting body shape sewed thereto made by combining woven fabrics together. Each of the fabrics has a modules of expansibility depending on a stretch direction from the weaving direction of the fabric and the garment comprises a lining as follows:

(a) a main section for wrapping the abdomen and the buttocks and regulating the shape of the buttocks, said main section containing
  - a front body covering the whole of the abdomen oriented in a direction that the direction of the high modules of expansibility of the fabric is in the lateral direction to the abdomen,
  - a back body with a curve conforming to the roundish shape of the buttocks oriented in a direction that the direction of the high modules of expansibility of the fabric is in a lateral direction to the buttocks, and
  - a buttocks regulating piece with a belt-like figure conforming to a curve of the peripheral part of the buttocks, said buttocks regulating piece is oriented in a direction that the direction of the high modules of expansibility of the fabric is suitable for gathering and pushing up the buttocks and sewed between said front body and said back body; and (b) an abdominal regulating piece for regulating the shape of the abdomen with a curve conforming to the abdomen, said abdominal regulating piece is formed of at least two sheets, each of the sheets is oriented in a direction that the direction of the low modules of expansibility of the fabric is in the lateral direction to the abdomen, and said sheets are sewed onto said front body so as to at least partially overlap each other within the abdominal region including the lower abdominal region.

In the garment, said back body is formed in a size for covering the buttocks, including the sides thereof, and is directly sewed to said front body so as to form the main section for wrapping and tightening the abdomen and the buttocks. Said buttocks regulating piece is sewed to said main section along the sides and the base of the buttocks.

In the garment, said abdominal regulating piece may be formed of at least two sheets, with each of the sheets having a figure like a short strip of paper with a curve conforming to the abdomen and oriented in a direction that the direction of the low modules of expansibility of the fabric is in the lateral direction to the abdomen. In case these sheets are sewed onto the front body, these sheets may be sewed diagonally onto said front body so as to cross each other within an abdominal region including the lower abdominal region.

In the garment, preferably, said main section comprises a slide fastener as a opening and closing portion for facilitating wearing and removing the garment together with the lining.

In the garment, said main section preferably comprises an opening for refuge at the under edge of an attachment portion where said slide fastener is attached that allows a fastener slider and a metal stopper of said slide fastener to pass therethrough.

In the garment, a part of said front body along the upper end joint of the thighbone is preferably replaced by a thigh stretching piece for relieving a wearer of a feeling of being compressed around the upper end joint of the thighbone by a movement of the joint, said thigh stretching piece is oriented in a direction that the direction of the high modules of expansibility of the fabric is identical to the joint.

In the garment, a plurality of said buttocks regulating pieces or a plurality of said abdominal regulating pieces may be superposed in a manner that the weaving directions of the fabrics are oriented in one direction.

According to another aspect of the present invention, the lining may be constituted as follows, when buttock sagging expands in the direction of the thighs and also in horizontal direction, requiring a buttocks regulating force which extends in a larger area.

The inner lining for adjusting body shape is made by combining at least one kind of woven fabric, each fabric has a modules of expansibility depending on a stretch direction from the weaving direction of the fabric, and said lining comprises:

(a) a main section for wrapping the abdomen and the buttocks from the directions of the thighs, said main section containing:

a front body for covering the whole of the abdomen, the buttocks, and an upper part of the thighs with a curve conforming to a roundish shape of the abdomen and the buttocks, said front body is oriented in a direction that the direction of the high modules of expansibility of the fabric is in the lateral direction to the abdomen, a back body with a curve conforming to a roundish shape of the buttocks oriented in a direction that the direction of the high modules of expansibility of the fabric is in the lateral direction to the buttocks, and a thigh stretching piece oriented in a direction that the direction of the high modules of expansibility of the fabric is in the lateral direction to the thigh;

(b) a buttocks regulating piece for wrapping and pushing up the sagged buttocks from the direction of the thighs and regulating the shape of the buttocks with a curved belt-like figure over the side lines and the thigh conforming to a curve of the peripheral part of the buttocks, said buttocks regulating piece is oriented in a direction that the direction of the high modules of expansibility of the fabric is suitable for pushing up the sagged buttocks and sewed onto said front body; and (c) an abdominal regulating piece for regulating the shape of the abdomen with a curve conforming to the abdomen, said abdominal regulating piece is oriented in a direction that the direction of the low modulus of expansibility of the fabric is in the lateral direction to the abdomen and sewed onto said front body. In the garment, said lining comprises a slide fastener so as to form an opening and closing portion.

According to another aspect of the present invention, the main section of the lining preferably comprises an abdominal regulating piece as described below, in case a regulating of the abdomen is particularly required in wearing a garment like skirt. The abdominal regulating piece is formed of at least two sheets. Each of the sheets is oriented in a direction that the direction of the low modulus of expansibility of the fabric is in the lateral direction to the abdomen, and is formed to have a figure with a curve conforming to the abdomen and a curve conforming to the upper end joint of the thighbone. When the abdominal regulating piece is sewed onto said front body, it is desirable that the sheets are sewed onto said front body so as to at least partially overlap each other within the abdominal region including the lower abdominal region. Concretely, each of the sheets of the abdominal regulating piece may be constructed in a figure like a curved short strip of paper with a curve conforming to the abdomen and a curve conforming to the upper end joint of the thighbone. At least two sheets of said abdominal regulating piece may be sewed diagonally onto said front body from the waist portion of the front body to the upper end joint of the thighbone to cross each other within the abdominal region including the lower abdominal region. In the garment, a buttocks regulating piece may be sewed onto said back body to boost the adjusting force and regulate the shape of the buttocks. The buttocks regulating piece has a curve conforming to the roundish shape of the buttocks, and is sewed in a position to push up the buttocks wrapped in the back body. The buttocks regulating piece may be formed of identical or nonidentical material, which has greatly much strengthened adjusting force, to that of main section corresponding to the aims and the function of the garment.

In the garment, said back body may comprise gathers at the central portion of the lower part thereof for regulating the buttocks three-dimensionally without flattening the roundish shape of the buttocks.

In some garments which closely fit to the body, the thermal insulating effect of the garment is sometimes insufficient when temperature is low, as in winter.

To solve the problem, woven fabrics with expansibility are used for the lining, each of these fabrics being made of far-infrared radiating material and woven in a manner that a modulus of expansibility of the fabric is dependent on a stretch direction from the weaving direction of the fabric.

When a person wears the garment, it is possible to keep warm by the effect of far-infrared radiation, in addition to adjust the shape of the body wrapped by the lining, by constructing a garment as described.

In the garment, preferably, said fabric with expansibility has a figure like a net in consideration for ventilation.

The wearer of the garment does not feel uncomfortable, for instance, when the wearer becomes moist with perspiration by exercises or in a heated room by constructing the garment as described.

In the garment, preferably, said main section has a length for covering a part of the thigh. By this modification, the thermal insulating effect and the body adjusting effect of the garments are extended to a larger area. In other words, it will be possible to keep a large area, including part of the thigh, warm while still efficiently adjusting the shape of the buttocks by picking up the superfluous flesh at the buttocks.

The garment having an inner lining sewed thereto for adjusting body shape of the present invention can be utilized for all kinds of garments such as slacks, skirts, dresses, culottes, or the like.

DETAILED DESCRIPTION OF THE PREFERRED EMBODIMENTS

EXAMPLE 1

A garment of the present invention having an inner lining sewed thereto for adjusting body shape will be described in further detail with reference to the accompany drawings.

Figure 1:
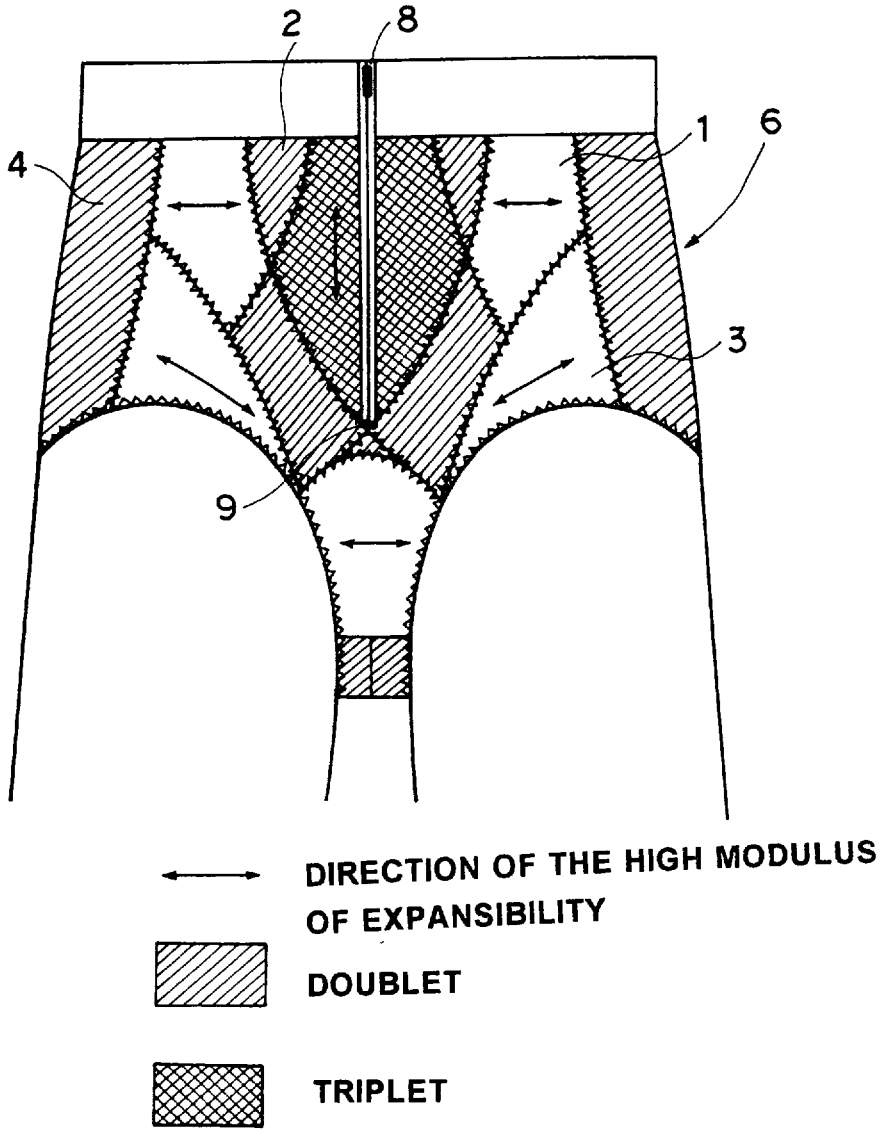
FIG. 1 is a front view of a lining for adjusting body shape according to a first example of the invention.
Figure 2:
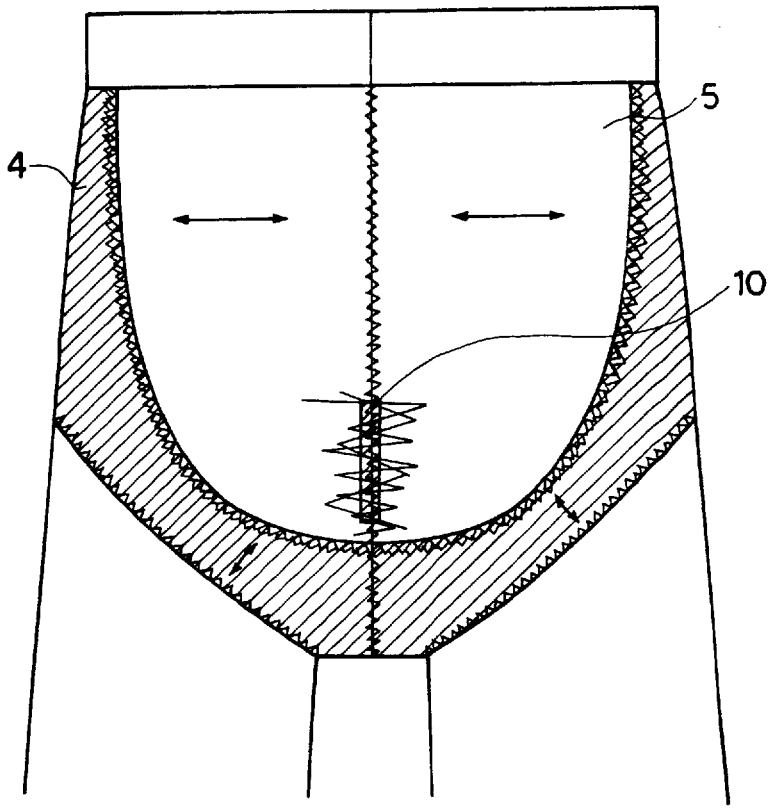
FIG. 2 is a rear elevational view of the lining for adjusting body shape according to the first example of the invention.
Figure 3:
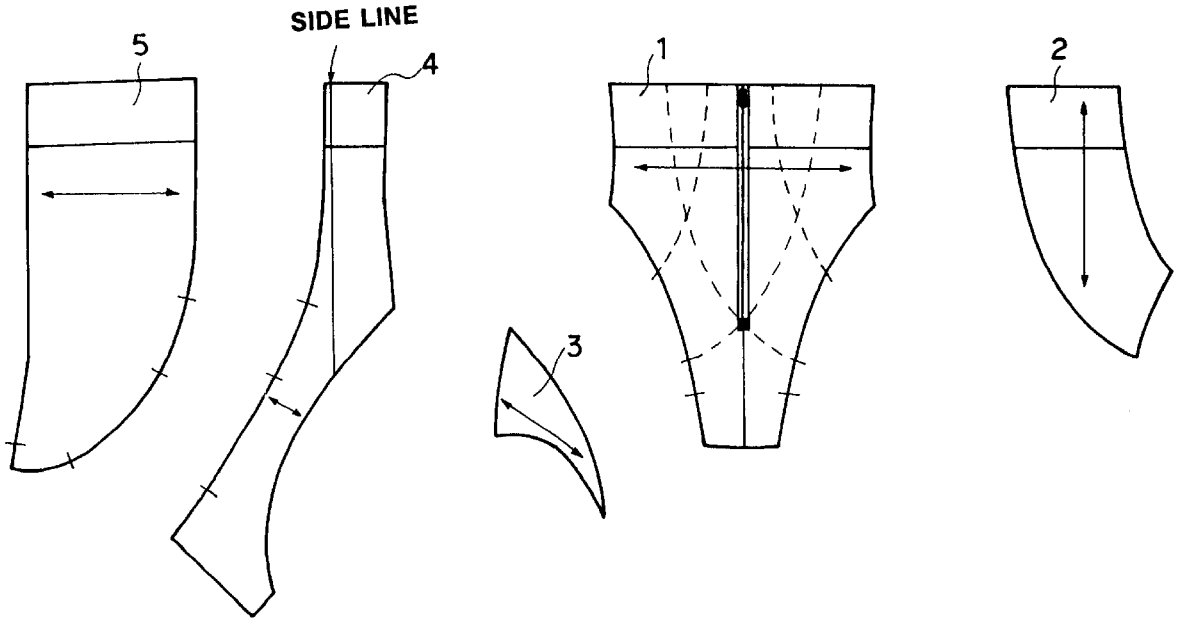
FIG. 3 shows parts of the lining according to first example of the invention.

Referring to FIG. 1, there is shown a front view of a lining in a garment having an inner lining sewed thereto according to a first example of the invention. A front body 1 and a buttocks regulating piece 2 are clearly depicted. Referring to FIG. 2, there is shown a rear elevational view of the lining in the garment having an inner lining sewed thereto according to the first example of the invention, and a back body 5 is clearly depicted. In FIGS. 1 and 2, slash marks indicate that two fabrics are superposed (doublet), while meshed marks indicate that three fabrics are superposed (triplet). FIG. 3 shows parts of the lining in the garment having an inner lining sewed thereto according to the first example of the invention.

A lining 6 fixed to the clothing (not shown) of the present example is made by sewing power net fabrics together. A modulus of expansibility of the power net fabric is dependent on a stretch direction from the weaving direction of the fabric. The direction of the high modulus of expansibility of the fabric is indicated by arrows.

The lining 6 is formed of a main section which is constituted by a front body 1, two thigh stretching pieces 3, the back body 5 and a buttocks regulating piece 4, and two abdominal regulating pieces 2.

The front body 1 is oriented in a direction that the direction of the high modulus of expansibility of the fabric is in the lateral direction to the abdomen of a wearer, has an area for covering the whole of the abdomen from the waist to upper part of the thigh, and has a deeply cut out shape around the thighs. The thigh stretching pieces 3 with a figure like a triangle is oriented in a direction that the direction of the high modulus of expansibility of the fabric is identical to the upper end thighbone joint, and sewed to the front body 1 at the deep cut out lines corresponding to the thighs so as to form straight lines at the side edges of the front body 1. The buttocks regulating piece 4 is formed of a pair of sheets. Each sheet is oriented in a direction that the direction of the high modulus of expansibility of the fabric is suitable for gathering and pushing up the buttocks (that is a direction in upper oblique toward the center of the buttocks), and sewed to the front body 1 and the thigh stretching pieces 3 at the right or the left straight line and at the part corresponding to the crotch of the front body 1. Each sheet is constituted by superposing two fabrics with a belt-like figure from the waist to the upper part of thigh oriented in the same direction. This buttocks regulating piece 4 has a curve conforming to the buttocks, a line corresponding to the side edge of the front body 1, a line conforming to the upper end joint of the thighbone, and a line conforming to the crotch. The back body 5 to be sewed to the buttocks regulating piece 4 at the curve conforming to the buttocks, is formed of a pair of sheets referred to as a right sheet and a left sheet, is oriented in a direction that the direction of the high modulus of expansibility of the fabric is in the lateral direction to the buttocks, and has an area enough for covering the waist and the roundish buttocks.

A right and a left abdominal regulating piece 2 are sewed onto the front body 1 of the above described main section respectively. In FIG. 3, where the abdominal regulating pieces 2 are sewed onto is shown by a dashed line. Each of the right and the left pieces has a figure like a slightly curved short strip of paper conforming to the abdomen and oriented in a direction that the direction of the high modulus of expansibility of the fabric is in the longitudinal direction to the abdomen (the direction of the low modulus of expansibility of the fabric is in the lateral direction to the abdomen). Two abdominal regulating pieces 2 are sewed diagonally onto the front body 1 to cross each other from the waist region of the front body 1 to the cut out line of the thighs so that an overlapped area is maximized over the lower abdominal region.

A slide fastener 8 provided at the center portion of the front body 1 has a 20 cm opening and closing portion 8*a*. An opening for refuge is provided at the lower end of the opening and closing portion 8*a* to allow a fastener slider and a metal stopper of the slide fastener 8 to pass therethrough.

A rubber sheet 10 is stretched at the lower region of the center line of the back part 5 which is made by sewing the right and the left part together. Gathers are formed on the back body 5 by a pressure of the rubber sheet 9, and therefore the back body 5 has a curved surface conforming to the roundish shape of the buttocks.

In the lining constituted as described above, the main section has elasticity in the lateral direction to the abdomen, because the front body 1 and the back body 5 are oriented in directions that the direction of the high modulus of expansibility of the fabric is in the horizontal direction. The buttocks regulating piece 4 constituted by superposing two fabrics is oriented in a direction that the direction of the high modulus of expansibility of the fabric is suitable for gathering and pushing up the buttocks, therefore, expansibility of the main section corresponding to the sides and the base of the buttocks is to be lower and elasticity is to be higher. Accordingly, the main section gathers and pushes up downward or lateral buttock sagging, then the main section softly tightens and wraps the pushed up sags. The roundish shape of the buttocks wrapped in the main section is also adjusted by the three-dimensional back body 5, the gathers of which are formed by the rubber sheet 9. It is possible that the rubber sheet 9 makes the buttocks appear to be pushed up. In this example, the body shape is easily and efficiently adjusted by partially using the abdominal regulating pieces 2 and the buttocks regulating piece 4 without giving an oppressive or offensive feeling to the wearer, unlike an undergarment such as a girdle firmly tightens all over the abdomen and the buttocks.

The thigh stretching piece 3 smooths a movement of the upper end joint of the thighbone, because the thigh stretching piece 3, oriented in a direction that the direction of the high modulus of expansibility of the fabric is the identical to the joint, is stretched along the joint. The thigh stretching piece 3 is able to prevent the lining from intruding into the joint according to movement of the joint, and able to create a comfortable feeling for the wearer.

Figure 4:
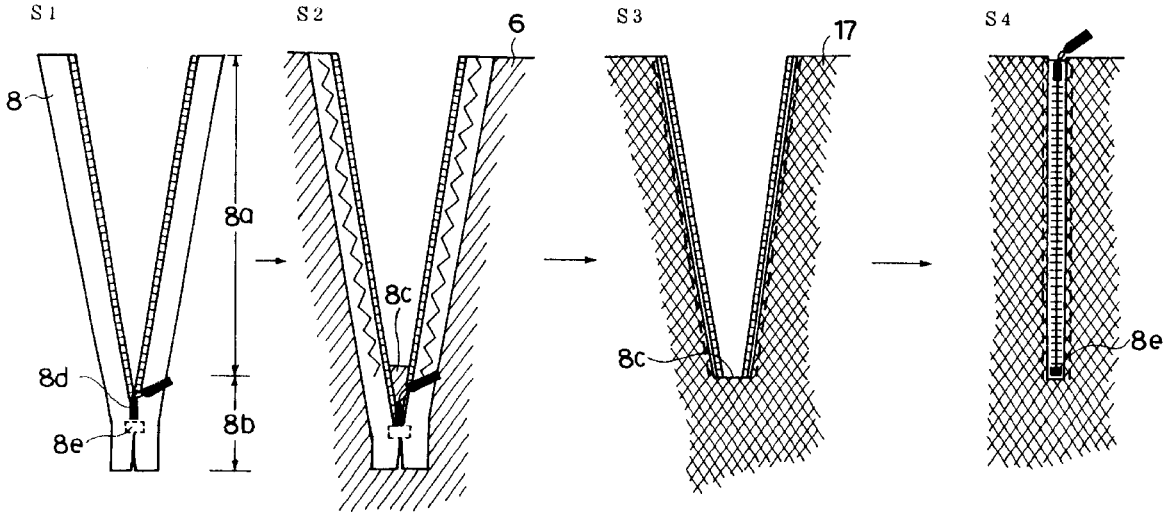
FIG. 4 shows steps of slide fastener sewing in a garment according to the first example of the invention.

The slide fastener 8 provided at the center portion of the front body 1 comprises a 20 cm opening and closing portion 8*a*, and thus facilitates wearing and removing the garment with the lining 6. In case a concealed fastener is used, however, a non-sewing part is formed at a position lower than the opening and closing portion 8*a* by the prior sewing method. For example, when the fastener is provided to the garment with the lining, the wearer of the garment may feel discomfort from contact with the non-sewing part. It is possible to manage the non-sewing part 8*b* causing such a feeling by providing an opening for refuge 8*c* at the under edge of an attachment portion where the slide fastener is attached that allows a fastener slider 8*d* and a metal stopper 8*e* of the slide fastener 8 to pass therethrough. The lining 6 with the slide fastener 8 and the garment are sewed together at the fastener portion in a condition that the slide fastener 8 is open. The fastener slider 8*d* and the metal stopper 8*e* at the lower end of the opening and closing portion 8*a* prevent a sewing machine needle from proceeding. Therefore, it is necessary to leave a non-sewing part 8*b* of a few centimeters in length for placing the fastener slider 8*d* and the metal stopper 8*e* at the lower end of the opening and closing portion 8*a*. However, as shown in FIG. 4, the slide fastener 8 is sewed to the lining 6 along the side edge of the opening and closing portion 8*a* in a condition that the slide fastener 8 is open (S1), so that the opening for refuge 8*c* is provided at the lower end of the opening and closing portion 8*a* of the lining side (S2). At this stage, the fastener slider 8*d* and the metal stopper 8*e* are placed at a position lower than the opening for refuge 8*c*. The slide fastener 8 is sewed to the garment along both side edges of the opening and closing portion 8*a* (S3). Thereinafter, the fastener slider 8*d* and the metal stopper 8*e* are pulled up through the opening for refuge 8*c*, the metal stopper 8*e* is fixed at the lower end of the opening and closing portion 8*a*, and a part of the non-sewing part 8*b* lower than the opening and closing portion 8*a* is cut off. In the example, by providing the opening for refuge 8*c*, it is possible to give a comfortable feeling to the wearer in wearing the garment with the lining 6 by managing the non-sewing part 8*b* of the lower end of the slide fastener 8 and eliminating the uncomfortable feeling caused by the non-sewing part 8*b*. The number of sheets of fabric used for the abdominal regulating piece 2 and the buttocks regulating piece 4 can be changed to modify the adjusting force, while in this example two sheets of fabric are superposed for the abdominal regulating pieces 2 and the buttocks regulating piece 4, respectively. The lining 6 is formed of one type of a power net fabric in this example. However, expansible material with a modulus of expansibility identical or nonidentical to the power net fabric may be used by a partial or whole replacement. It is possible to obtain a material with a modulus of expansibility and a modulus of elasticity, which are equal to or more than that of a material made by superposing the power net fabrics, by using lower expansibility and higher elasticity material than the power net fabric for the bodies and the regulating pieces, and obtain a lining which have a high adjusting force without superposing many fabrics.

It is easily understood that the lining of the present example is applicable not only to slacks but also, for example, to culottes or the like.

EXAMPLE 2

Figure 6:
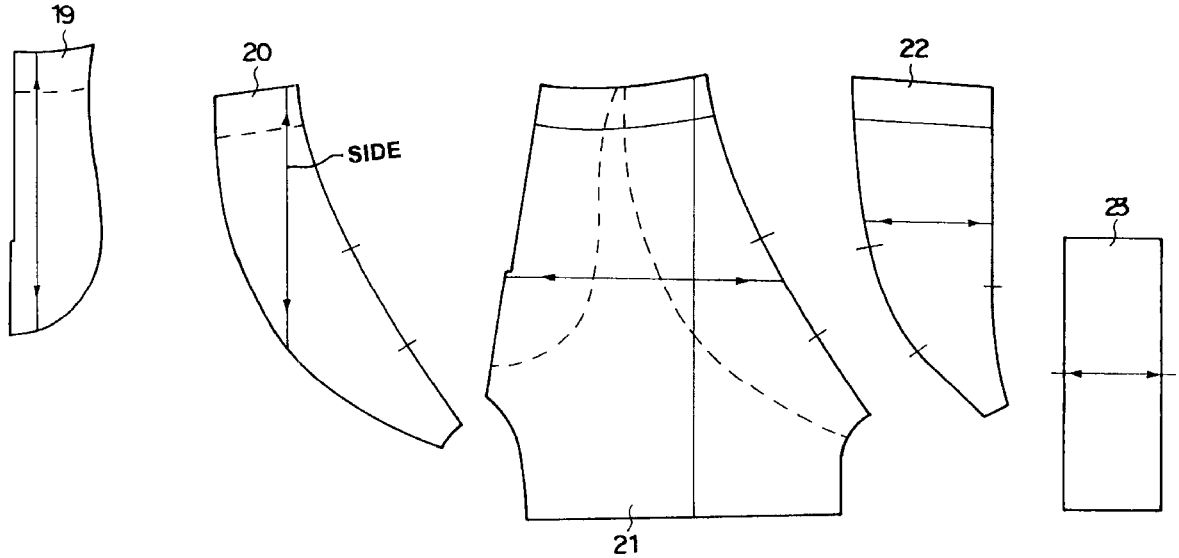
FIG. 6 shows part of a lining in a garment according to a second example of the invention.

In FIG. 6, parts of the lining in the garment having an inner lining sewed thereto for adjusting body shape according to a second example of the invention are shown. The lining of the present example is of a long type. A front body 21, which is constructed by a pair of a right part and a left part, is oriented in a direction that the direction of the high modulus of expansibility of the fabric is in the lateral direction to the abdomen of a wearer, has a length from the waist to the half of the thighs and a width from the central front portion to a portion along the roundish shape of the peripheral part of the buttocks. The front body 21 made by sewing the right part and the left part together at the central front portion has an area for covering from the whole of the abdomen to the sides of the roundish buttocks.

A back body 22, which is constructed by a pair of a right part and a left part, is oriented in a direction that the direction of the high modulus of expansibility of the fabric is in the lateral direction to the abdomen of the wearer, and sewed along the roundish shape of the peripheral part of the buttocks of the front body 21. The back body 22, made by sewing the right part and the left part together, has an area for covering the roundish shape of the buttocks from the waist. A natural roundish shape of the buttocks is formed by making gathers at the central portion of the lower part of the back body 22 at the time the right part and the left part are joined.

A front body and a back body usually refers to a forward part and a backward part of the side line. The front body 21 of the present example includes a part of the back body according to this definition, and the back body 22 is smaller than an usual one and only constitutes a part corresponding to the roundish part of the buttocks. In this lining, therefore, the sewing line of the front body 21 and the back body 22 is along the roundish shape of the buttocks in this lining.

The rectangular thigh stretching piece 23 is oriented in a direction that the direction of the high modulus of expansibility of the fabric is in the lateral direction to the thighs, and sewed between parts of the front body 21 corresponding to inner parts of the opposing thighs through the crotch where the back body 22 is sewed. The sewed part around the lower end of the thigh is catch-stitched (zigzag-stitched) for preventing the fabrics from raveling at the cutting end.

The main section for wrapping the abdomen and the buttocks from the direction of the thighs is made by sewing the front body 21, the back body 22 and the thigh stretching piece 23 together.

A buttocks regulating piece 20 with a belt-like figure over the side line and the thigh conforming to a curve of the peripheral part of the roundish buttocks is oriented in a direction that the direction of the high modulus of expansibility of the fabric is suitable for pushing up sags in the buttocks, and sewed onto the front body 21 conforming to the right side dashed line shown in FIG. 6.

An abdominal regulating piece 19 with a curve conforming to the abdomen is oriented in a direction that the direction of the low modulus of expansibility of the fabric is in the lateral direction to the abdomen, and sewed onto the front body 21 conforming to the left side dashed line shown in FIG. 6.

A slide fastener provided at the central front portion of the front body 21 where the right part and the left part are sewed together comprises a 20 cm opening and closing portion.

The garment with the inner lining for body shape adjustment of this example is constituted by attaching the above described lining to the garment at the waist part and the fastener part.

In the garment with the inner lining for body shape adjustment of this example, a sagging abdomen, sagging buttocks, and upper thighs are softly wrapped in the main section, because the main section is made by sewing the front body 21, the back body 22, and the thigh stretching piece 23 together; the front body 21 is oriented in a direction that the direction of the high modulus of expansibility of the fabric is in the lateral direction to the abdomen; and the back body 22 is oriented in a direction that the direction of the high modulus of expansibility of the fabric is in the lateral direction to the buttocks. The wrapping force caused by expansibility of the fabric is not divided at the side line because the front body 21 includes a backward part of the side line which is usually referred to as the back body so that the fabric of the front body expands beyond the side line to a lesser degree than in the usual front body. Accordingly, the main section comprising the above described front body is able to wrap the sagged abdomen and the sagged buttocks from the direction of the abdomen in a manner that the abdomen and the buttocks are regarded as be united.

A thigh stretching piece 23 sewed between parts of the front body 21 corresponding to inner parts of the opposing thighs does not give a compressed feeling to the wearer even the garment is a long type, because the thigh stretching piece 23 is oriented in a direction that the direction of the high modulus of expansibility of the fabric is in the lateral direction to the thigh and therefore it stretches along the thighs. For preventing the fabric from raveling at the cutting end, the lower end of the thigh of the front body is not folded back but catch-stitched at the cutting end, then the thickness of the garment at the cutting end can be reduced in comparison with the folding back method. The figure of the lining is then barely visible on the surface of the garment.

A buttocks regulating piece 20 has a figure with a curved belt-like figure over the side line and the thigh conforming to a curve of the peripheral part of the buttocks. The buttocks regulating piece 20 is oriented in a direction that the direction of the high modulus of expansibility of the fabric is suitable for pushing up sagging buttocks, and sewed onto the front body 21 so that a part of the main section where the buttocks regulating piece 20 is sewed has a reduced expansibility and an increased elasticity. This makes it possible to regulate the shape of the buttocks by pushing up the wrapped sags of the buttocks from the upper part of the thighs and regulating the shape of the buttocks. In this example, a larger area can be adjusted by using the long type lining in comparison with the first example. The body shape is adjusted by putting the pushed up sags in the back body 22 having a natural roundish shape with gathers.

An abdominal regulating piece 19 with a curve conforming to the abdomen is oriented in a direction so that the direction of the low modulus of expansibility of the fabric is in the lateral direction to the abdomen. The abdominal regulating piece 19 is sewed onto the front body 21 so that the high expansibility of the main section is decreased and a part of the main section where the abdominal regulating piece 19 is sewed has a reduced expansibility and increased elasticity. This makes it possible to regulate the shape of the abdomen by pressing the sags of the abdomen which are wrapped in the main section.

In the garment of the present example, wearing and removal of the garment are facilitated by comprising the slide fastener as an opening and closing portion of the lining.

The length of the long type lining in the garment of the present example is changeable in various lengths. When the lining is made longer to cover the thighs, an effect for making the thighs look slim can be obtained. The garment according to the present example can adjust the body shape without reducing the adjusting force, because the front body 21, the back body 22, the abdominal regulating piece 19, and the buttocks regulating piece 20 are sewed together, while in the prior art each of the pieces is individually attached to the garment. It is possible to adjust the sagging abdomen and the buttocks of a larger area, even if the lining is long.

EXAMPLE 3

Figure 5:
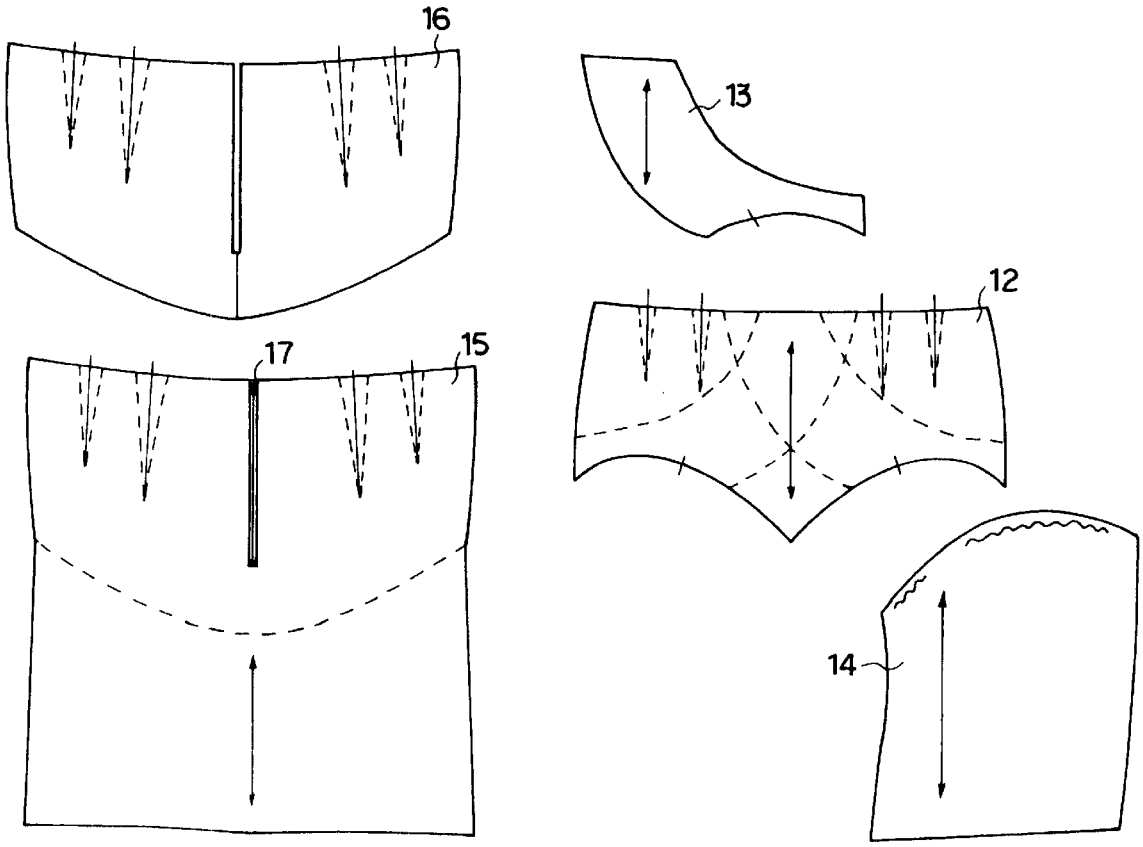
FIG. 5 shows parts of a lining according to a third example of the invention.

FIG. 5 shows parts of the lining for skirt with a function of adjusting body shape according to a third example of the invention. The lining is attached to the skirt at the waist part and the slide fastener is made by sewing high expansibility material, low expansibility material, and an interlining. A front body 12 has an area for covering the whole of the abdomen and extends from the waist to curves along the upper end joints of the thighbones. The front body 12 is formed of a power net fabric in which a modulus of expansibility is dependent on a stretch direction from the weaving direction of the fabric, and oriented in a direction that the direction of the high modulus of expansibility of the fabric is in the lateral direction to the abdomen of a wearer. Darts are provided at the waist part of the front body 12. A front skirt piece 14 formed of a power net fabric with a size from the upper end of the thighbone to the lower edge of the skirt is oriented in a direction identical to that of the front body 12. The front body 12 and the front skirt piece 14 is sewed together to make gathers at the front skirt piece 14.

The back body 15, which is formed of a power net fabric and provided with darts at the waist part, has a length from the waist to the lower end of the skirt and is oriented in a direction that the direction of the low modulus of expansibility of the fabric is in the lateral direction to the buttocks. The main section for wrapping the abdomen and the buttocks is constituted by sewing the back body 15 to the front body 12 and the front skirt piece 14.

An abdominal regulating piece 13 is oriented in the direction that the direction of the low modulus of expansibility of the fabric is in the lateral direction to the abdomen, and has a figure like a short strip of paper with a curve conforming to the abdominal curve at the upper side and a curve conforming to a cut out line around the upper end joint of the thighbone at the lower side. Two abdominal regulating pieces 13 are sewed diagonally onto the front body 12 to cross each other from the waist to the cut out line around the upper end joint of the thighbone so that an overlapped area is maximized over the lower abdominal region.

A buttocks regulating piece 16 is made by sewing a low expansibility rigid fabric (such as "sleek") and an interlining. The buttocks regulating piece 16 has a three-dimensional roundish shape conforming to the shape of the buttocks by carrying a figure with a curve conforming to the waist side line and the roundish shape of the buttocks and providing the darts at the waist. The buttocks regulating piece 16 is sewed onto the back body 15 at a part from the waist to the buttocks conforming to the dashed line shown in FIG. 5.

A slide fastener 17 with an opening and closing portion of 20 cm in length is provided at the center portion of the back body 15 and the buttocks regulating piece 16, with an end of the slide fastener 17 at the waist position.

In the present lining, the main section is able to wrap the abdomen and the buttocks and to softly tighten sagging of these regions in the lateral direction because the power net forming the front body 12 and the back body 15 of the main section are oriented in directions so that the direction of the low modulus of expansibility of the fabric is in the lateral direction. These bodies of the main section are sewed to fit the body by the darts formed at the waist position.

In the abdominal region, a reduced lateral expansibility and an increased lateral elasticity can be obtained at the sewing part because two abdominal regulating pieces 13, which are formed of power net and oriented in directions identical to the main section, are sewed diagonally so as to cross each other. Accordingly, in the abdominal sagging in the area is wrapped strongly pressed main section so that the abdomen can not be recognized outwardly.

The shape of the buttocks wrapped by the main piece is regulated by the buttocks regulating piece 16 which is formed in a three-dimensional shape conforming to the shape of the buttocks and the waist is made of "sleek", a low expansibility rigid material, and the interlining is sewed onto the back body 15.

In the garment of the present example, wearing and removal of the garment will be facilitated by utilizing the slide fastener as an opening and closing portion of the lining.

When a fastener is provided, if material of a part where the fastener is attached is expansible, the fastener is pulled because of the expansibility of the material which usually will result in a rippling or a corrugation of the fastener. However, in this example, expansibility in the area where the fastener is attached can be reduced by sewing onto the back body 15 a low expansibility, low elasticity material and the interlining. It is possible, to thereby avoid the problem of fastener corrugation. Another method for avoiding fastener corrugation is superposing expansible material to reduce expansibility and to increase elasticity of the lining.

Accordingly, either identical material to that of the main section or a material with a different expansibility and an elasticity may be used for the buttocks regulating piece 16.

In addition to the buttocks regulating piece 16, a material with different expansibility and elasticity material may be used in the abdominal region for the buttocks regulating piece 13 to change the regulating strength to the abdomen.

The lining of the present example has a same structure as a skirt in that a part of the crotch is not sewed so that a wearer is able to easily put on the garment without discomfort.

Though a skirt has been described, this invention is also applicable to a garment covering the upper body, such as a dress. In such a case, the lining according to the present invention may be constructed with the lining of the upper half of the body in one continuous body, or may be a separate body.

As explained above, the garment lining the shape of the abdomen and the buttocks can effectively be adjusted utilizing fabric with a modulus of expansibility that depends on the stretch direction from the weaving direction of the fabric. This body type lining with a body shape adjusting effect is attached to the garment enabling the garment wearer to easily adjust body shape without annoyance of a separate girdle. In addition, an economic benefit that additional undergarments for adjusting the body shape need not be purchased. Unlike a girdle, which tightens the entire body, the lining does not give an oppressive or offensive feeling to the wearer because it tightens only the sagging body parts. Also, a lining not as well as the prior lining can effectively tighten the a sagging abdomen and three-dimensionally adjust the sagging buttocks.

In a long lining with a long main section, the buttocks regulating piece 16 will have a larger area than that of the above example to gather and push up the sagging larger area. Such a long lining may give the wearer an oppressive or offensive feeling at the thighs. However, this problem can be eliminated by providing a thigh stretching piece oriented so that the direction of the high modulus of expansibility of the fabric is in the lateral direction to the thigh and sewed to the inner parts of the thighs.

Conversely, it is possible to make the thighs look slim by lengthening the long type lining so as to cover the thighs if the wearer wishes to tighten sagging thighs.

EXAMPLE 4

Figure 7:
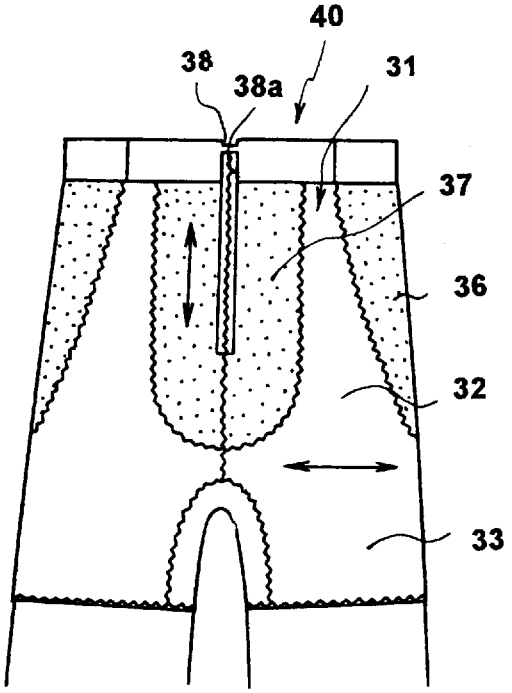
FIG. 7 is a front view of a lining in a garment according to a fourth example of the invention.
Figure 8:
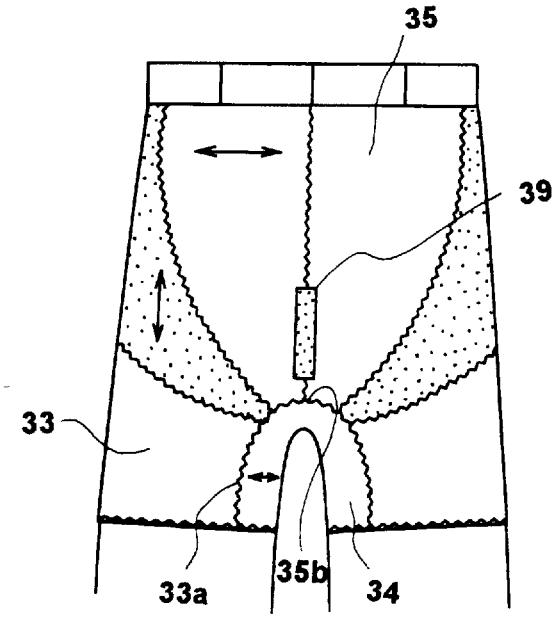
FIG. 8 is a rear elevational view of the lining in the garment according to the fourth example of the invention.
Figure 9:
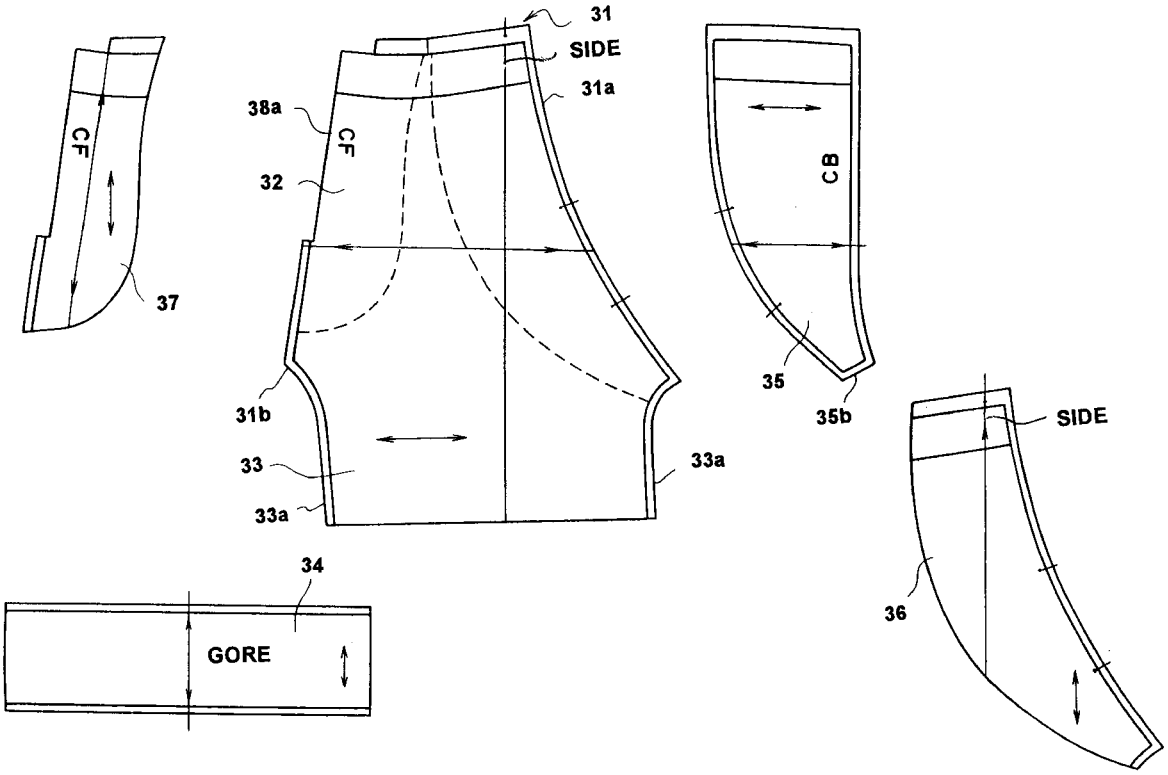
FIG. 9 shows parts of the lining in the garment according to the fourth example of the invention.

FIG. 7 shows a front view of the lining in a garment according to a fourth example of the invention in which a front body 31 and an abdominal regulating piece 37 are clearly depicted. FIG. 8 shows a rear elevational view of the lining, with a back body 35 and a buttocks regulating piece 36 are clearly depicted. FIG. 9 shows parts of the lining.

For the fabric of the lining 40, a far-infrared radiative material, for example an original yarn which is mixed with far-infrared radiative ceramic by kneading such as "MASONIC N@" (trademark of Kanebo, Ltd.), can be used "MASONIC N@" radiates about 10% more far-infrared radiation than a prior original yarn (nylon). Any original yarn can be used for the present invention. Not only the above described original yarn, but also another original yarn that radiates at least about 10% more far-infrared than a usual original yarn may be used. The fabric for the lining 40 is made by weaving such an original yarn material into a figure like a power net, wherein the power net fabric has a modulus of expansibility depending on a stretch direction from the weaving direction of the fabric. A desired modulus of expansibility of the woven fabric can be obtained by changing the weaving method.

The lining 40 made by sewing the woven fabrics together consists of the main section constituted by joining the front body 31, a crotch stretching piece 34, and the back body 35; the abdominal regulating piece 37; and the buttocks regulating piece 36, these pieces 36, 37 are sewed to the predetermined position of the main section mentioned later. The construction of these pieces will be explained in detail. In FIG. 7, the direction of the high modulus of expansibility of each of the fabric is indicated by arrows.

The front body 31 is oriented in a direction that the direction of the high modulus of expansibility of the fabric is in the lateral direction to the abdomen, and formed of an abdominal covering piece 32 for covering the whole of the abdomen, including the side lines from the waist to the crotch, and a thigh covering piece 33 for covering upper parts of the thighs. In this example, the front body 31, which may be made in one piece, is made by sewing two parts together at the central front line.

The back body 35 sewed to the front body 31 along a buttocks curve 3 la is oriented in a direction that the direction of the high modulus of expansibility of the fabric is in the lateral direction to the buttocks or in an oblique direction that is suitable for pushing sagging buttocks up towards the center, and has a figure like a slightly elongated hemicircle conforming to a roundish curve of the buttocks. The back body 35, which may be formed of one sheet of fabric, is preferably made by sewing two sheets together at the center part for adjusting the shape of the buttocks without crushing the roundish shape of the buttocks.

The crotch stretching piece 34 is sewed between the side lines 33*a* of the thigh covering piece 33 of the front body 31, and between the crotch portion 31*b* of the front body 31 and crotch line 35*b* of the back body 35. The crotch stretching piece 34 is oriented in a direction that the direction of the high modulus of expansibility of the fabric is in the lateral direction to the thigh so that it does not give an oppressive feeling to the wearer at the thighs and restrict movements of the upper end joints of the thighs.

The buttocks regulating piece 36 is oriented in a direction that the direction of the high modulus of expansibility of the fabric is suitable for gathering and pushing up the sagged buttocks, for example in an upper oblique direction that the direction of the high modulus of expansibility of the fabric is toward the center of the buttocks. The buttocks regulating piece 36 has a figure conforming to the roundish curve of the buttocks for wrapping the buttocks from the outskirts of it, and is sewed onto the front body 31 conforming to the right side dashed line shown in FIG. 9 along the buttocks curve 31*a*.

A rubber sheet 39 is strained at the center portion of the buttocks of the back part 35. Gathers are formed on the back body 35 by pressure of the rubber sheet 39, so the back body 35 has a curved surface for regulating the roundish shape of the buttocks which are pushed up by the buttocks regulating piece 36.

The abdominal regulating piece 37 covering around the central abdominal part of the front body 31 is oriented in a direction that the direction of the high modulus of expansibility of the fabric is lateral to the abdomen, that is a direction identical to that of the front body 31. Therefore, it is possible to regulate a sagging abdomen by increasing the elasticity at a part where the abdominal regulating piece 37 is sewed and increasing the force for tightening the extra abdominal flesh.

The abdominal regulating piece 37 may be oriented in a direction, contrary to the above described direction, that the direction of the high modulus of expansibility of the fabric is in the longitudinal direction to the abdomen. In this case, the pushing force against the sagging abdomen is increased because the abdominal regulating piece 37, which is oriented in the direction contrary to the front body 31, negates expansibility of the front body 31.

In this lining, a desired degree of regulating is achieved by controlling the number of superposed fabrics of the buttocks regulating piece 36 and the abdominal regulating piece 37 or utilizing a power net material which has a modulus of expansibility different from that of the buttocks regulating piece 36 and the abdominal regulating piece 37.

A slide fastener 38 provided along the central front line is sewed so as to superpose an opening of the garment (not shown in FIG. 7) and the lining on an opening and closing portion 38*a*. An opening for refuge is provided at the lower end of the opening and closing portion 38*a* for allowing a fastener slider and a metal stopper of the slide fastener 38 to pass therethrough.

The function of the lining constituted as above will be described as follows.

The front body 31 and the back body 35 are able to softly tighten and wrap the abdomen and the buttocks in the main section because they are oriented in directions that the direction of the high modulus of expansibility of the fabric is in the lateral direction to the abdomen and the buttocks respectively.

The crotch stretching piece 34 is oriented in a direction that the direction of the high modulus of expansibility of the fabric is in the lateral direction to the thigh so that elasticity of the crotch stretching piece 34 is increased in the lateral direction, the superfluous flesh of the thighs is softly tightened, and sagging buttocks are wrapped without giving an oppressive feeling to the wearer at the thighs.

It is possible to prevent a panty line from being visible when wearing a garment on trial which closely fits to the body by creating a length of the main section so as to cover the upper parts of the thighs.

The buttocks regulating piece 36 oriented in a direction that the direction of the high modulus of expansibility of the fabric is able to push up and tighten sagging buttocks wrapped in the main piece and sagging thighs through reduction of the expansibility of the sides and base of the buttocks of the main section and increasing the elasticity of these portions.

The buttocks, which are pushed up and tightened by the buttocks regulating piece 36, are adjusted to form a natural roundish shape by the back body 35, which is formed to have a natural roundish shape by the rubber sheet 39 strained at the back part 35.

The abdominal regulating piece 37 oriented in a same direction as the front body 31, wherein the direction of the high modulus of expansibility of the fabric is lateral to the abdomen, is sewed to the front body 31 and is able to increase the elasticity of the front body 31, thereby tightening a sagging abdomen three-dimensionally. In case the abdominal regulating piece 37 is oriented in a direction contrary to the front body 31, that the direction of the high modulus of expansibility of the fabric is longitudinal to the abdomen, it is possible to increase a pushing force of the front body 31 so that the sagged abdomen is pushed down. In the garment of the present example, wearing and removal can be facilitated by comprising the slide fastener 38 as an opening and closing portion of the lining.

As described above, the lining according to the present invention is formed of fabric which is woven by a far-infrared radiating original yarn so that it is possible for the lining to keep the body warm by radiating far-infrared energy while adjusting the shape of the body wrapped by the lining.

Accordingly, body temperature can be maintained even in low temperature circumstances, for example, during winter or in an air-conditioned room, so that waist and abdomen chill are prevented. It is possible to make the body shape of the wearer look tight and slim because the necessity for wearing other garments or undergarments is removed. This means that the effect of the garment with the lining for adjusting the body shape can be maintained.

While there have been described what are at present considered to be preferred embodiments of present invention, it will be understood that various modifications may be made thereto, and it is intended that the appended claims cover all such modifications as fall within the true spirit and scope of the invention.

What is claimed is:

1. A garment having an inner lining sewed thereto for adjusting body shape made by combining woven fabrics, each of which has a modulus of expansibility depending on a stretch direction from the weaving direction of the fabric, wherein said lining comprises:

a main section for wrapping the abdomen and the buttocks and regulating the shape of the buttocks, said main section containing a front body for covering the whole of the abdomen oriented in a direction that the direction of the high modulus of expansibility of the fabric is lateral to the abdomen; a back body with a curve conforming to a roundish shape of the buttocks oriented in a direction that the direction of the high modulus of expansibility of the fabric is lateral to the buttocks; and a buttocks regulating piece with a belt-like figure conforming to a curve of the peripheral part of the buttocks, said buttocks regulating piece being oriented in a direction that the direction of the high modulus of expansibility of the fabric is suitable for gathering and pushing up the buttocks and sewed between said front body and said back body; and an abdominal regulating piece for regulating the shape of the abdomen with a curve conforming to the abdomen, said abdominal regulating piece being formed of at least two sheets, each of which is oriented in a direction so that the direction of the low modulus of expansibility of the fabric is lateral to the abdomen, and said sheets are sewed onto said front body so as to at least partially overlap each other within the abdominal region including the lower abdominal region.

2. A garment according to claim 1, wherein said back body is of a size to cover the buttocks, including the sides thereof, and is directly sewed to said front body so as to form the main section for wrapping and tightening the abdomen and the buttocks, and said buttocks regulating piece is sewed to said main section along the sides and the base of the buttocks.

3. A garment according to claim 1, wherein said abdominal regulating piece is formed of at least two parts, each of which has a rectangle shape with a curve conforming to the abdomen and oriented in a direction that the direction of the low modulus of expansibility of the fabric is lateral to the abdomen, and said parts are sewed diagonally onto said front body to cross each other within the abdominal region including the lower abdominal region.

4. A garment according to claim 1, wherein said main section comprises a slide fastener so as to form an opening and closing portion.

5. A garment according to claim 4, wherein said main section comprises an opening for refuge at the lower end of an attachment portion where said slide fastener is attached that allows a fastener slider and a metal stopper of said slide fastener to pass therethrough.

6. A garment according to claim 1, wherein a part of said front body along the upper end joint of the thighbone has a thigh stretching piece for relieving a feeling of compression around the upper end joint of the thighbone according to a movement of the joint, said thigh stretching piece is oriented in a direction that the direction of the high modulus of expansibility of the fabric is the identical to the joint.

7. A garment according to claim 1, wherein a plurality of said buttocks regulating pieces or a plurality of said abdominal regulating pieces are superposed in a manner that the weaving directions of the fabrics are oriented in one direction.

8. A garment having an inner lining sewed thereto for adjusting body shape made by combining woven fabrics, each which has a modulus of expansibility depending on a stretch direction from the weaving direction of the fabric, wherein said lining comprises:

a main section for wrapping the abdomen and the buttocks from the directions of the thighs, said main section containing a front body for covering the whole of the abdomen, the buttocks, and an upper part of the thighs with a curve conforming to a roundish shape of the abdomen and the buttocks, said front body being oriented in a direction that the direction of the high modulus of expansibility of the fabric is lateral to the abdomen; a back body with a curve conforming to a roundish shape of the buttocks oriented in a direction that the direction of the high modulus of expansibility of the fabric is lateral to the buttocks; and a thigh stretching piece oriented in a direction that the direction of the high modulus of expansibility of the fabric is lateral to the thigh;

a buttocks regulating piece for wrapping and pushing up the sagged buttocks from the direction of the thighs and regulating the shape of the buttocks with a curved belt-like figure over the side lines and the thigh conforming to a curve of the peripheral part of the buttocks, said buttocks regulating piece being oriented in a direction that the direction of the high modulus of expansibility of the fabric is suitable for lifting sagging buttocks and being sewed onto said front body; and an abdominal regulating piece for regulating the shape of the abdomen with a curve conforming to the abdomen, said abdominal regulating piece being oriented in a direction that the direction of the low modulus of expansibility of the fabric is lateral to the abdomen and sewed onto said front body.

9. A garment according to claim 8, wherein said lining comprises a slide fastener so as to form an opening and closing portion.

10. A garment having an inner lining sewed thereto for adjusting body shape made by combining one or more kinds of woven fabrics, each of which has a modulus of expansibility depending on a stretch direction from the weaving direction of the fabric, wherein said lining comprises:

a main section for wrapping and tightening the abdomen and the buttocks, said main section containing a front body oriented in a direction that the direction of the low modulus of expansibility of the fabric is in the lateral direction to the abdomen, and a back body sewed to said front body and oriented in a direction that the direction of the low modulus of expansibility of the fabric is lateral to the buttocks and sewed to said front body;

an abdominal regulating piece for regulating the shape of the abdomen formed of at least two sheets, each of the sheets has a shape with a curve conforming to the abdomen and a curve conforming to the upper end joint of the thighbone and is oriented in a direction that the direction of the low modulus of expansibility of the fabric is lateral to the abdomen, and said sheets are sewed onto said front body so as to at least partially overlap each other within the abdominal region including the lower abdominal region; and a buttocks regulating piece for regulating the shape of the buttocks with a curve conforming to the roundish shape of the buttocks and said buttocks regulating piece being sewn onto the back body and formed of either as same or a different material as that of the main section.

11. A garment according to claim 10, wherein said abdominal regulating piece is formed of at least two sheets, each which has a rectangle shape with a curve conforming to the abdomen and a curve conforming to the upper end joint of the thighbone and is oriented in the direction that the direction of the low modulus of expansibility of the fabric is in the lateral direction to the abdomen, and said sheets are sewed diagonally onto said front body from the waist portion of the front body to the upper end joint of the thighbone to cross each other within the abdominal region including the lower abdominal region.

12. A garment according to claim 10, wherein said main section comprises a slide fastener so as to form an opening and closing portion.

13. A garment according to claim 1, wherein said lining is made by combining expansible woven fabrics, each which is made of far-infrared radiative original yarn containing far-infrared radiating material and woven in a manner that a modulus of expansibility of the fabric is dependent on a stretch direction from the weaving direction of the fabric.

14. A garment according to claim 13, wherein said expansible fabric is a figure like a net.

15. A garment according to claim 13, wherein said main section has a length for covering a part of the thigh.

16. A garment according to claim 13, wherein said main section comprises a slide fastener.

17. A garment according to claim 13, wherein said back body comprises gathers at the central portion of the lower part thereof.

* * * * *